United States Patent [19]

Kalbfuss

[11] 4,211,069

[45] Jul. 8, 1980

[54] COMBUSTION CHAMBER FOR A GAS TURBINE

[75] Inventor: Richard Kalbfuss, Mannheim, Fed. Rep. of Germany

[73] Assignee: BBC Brown Boveri & Company Limited, Baden, Switzerland

[21] Appl. No.: 918,157

[22] Filed: Jun. 22, 1978

[30] Foreign Application Priority Data

Jun. 24, 1977 [DE] Fed. Rep. of Germany ..... 2728399

[51] Int. Cl.[2] ..... F02C 7/12

[52] U.S. Cl. ..... 60/39.02; 60/757; 60/759; 60/760; 60/39.23

[58] Field of Search ..... 60/39.02, 39.65, 39.66, 60/39.69; 431/351, 352

[56] References Cited

U.S. PATENT DOCUMENTS

| | | | |
|---|---|---|---|
| 2,669,090 | 2/1954 | Jackson | 60/39.65 |
| 2,973,624 | 3/1961 | Pierce et al. | 60/39.65 |
| 3,652,181 | 3/1972 | Wilhelm | 60/39.66 |
| 3,869,864 | 3/1975 | Bunn | 60/39.66 |
| 4,085,579 | 4/1978 | Holzapfel | 60/39.65 |

*Primary Examiner*—Louis J. Casaregola

*Attorney, Agent, or Firm*—Burns, Doane, Swecker & Mathis

[57] ABSTRACT

A combustion chamber of a gas turbine engine has a combustion cowl and transition piece with at least one air gap provided therebetween. The air gap opens into an intermediate chamber having two throttles which are arranged oppositely with respect to one another. The two throttles are provided in a cooling jacket which is divided into two portions by the throttles. The air gap permits the combustion cowl and transition piece to expand freely with respect to each other. The two throttles are arranged so that fuel gas leaving the combustion chamber provides an injector effect to expedite the flow of a coolant such as air through the air gap.

19 Claims, 4 Drawing Figures

COMBUSTION CHAMBER FOR A GAS TURBINE

BACKGROUND AND SUMMARY OF THE PRESENT INVENTION

The present invention generally relates to a combustion chamber for a gas turbine engine having a combustion cowl that is surrounded by a cooling jacket through which is flowing combustion air. An open end of the combustion cowl leads into a transition piece, which is also covered by the cooling jacket, for the discharge of the combustion gases.

In a combustion chamber, the area of transition from the combustion cowl to the transition piece is critical and must be designed with particular care. The components being subjected to high running temperatures, must be able to expand radially as well as axially without interfering with each other. Furthermore, it is necessary to provide sufficient cooling for the area of transition. It is desirable to use only a relatively small amount of coolant for this cooling purpose, especially if the coolant, after its use, is to be removed from the area of transition together with the generated hot combustion gases. The known combustion chambers of the type described above do not meet these requirements.

It is therefore an object of the present invention to provide a combustion chamber of the above-defined type wherein a region of transition from the combustion cowl to the transition piece is arranged in such a manner that the various components will be able to expand freely and without touching one another. At the same time a proper amount of cooling is provided at the area of transition by a simple and controlled flow of air or some other coolant.

Another object of the present invention is to provide a combustion chamber that is simple in construction, will meet all operational requirements and has a long service life.

The present invention solves the problems of the prior art and includes at least one air gap formed between the combustion cowl and the transition piece. The at least one air gap opens into an intermediate chamber which is bordered within the area of transition from the combustion cowl to the transition piece by two throttles. The two throttles are arranged in the cooling jacket at a distance from, and opposite to each other. The throttles also serve to divide the cooling jacket into a first cooling jacket which primarily surrounds the combustion cowl and which serves to supply the air of combustion, and into a second cooling jacket which mainly surrounds the transition piece and which can be loaded with a gaseous coolant. The gaseous coolant is preferably air and is at a pressure that is higher than the pressure of the fuel gas within the area of the transition from the combustion cowl to the transition piece. The chamber formed between the throttles is in communication with the cooling jackets by way of a plurality of throttle gaps.

The air gaps formed between the combustion cowl and the transition piece allow these components to expand freely and independently from each other in radial as well as axial directions. The cooling of the area of transition is accomplished by the air and coolant flowing from the intermediate chamber through the air gap into the transition piece, with the flow of the coolant, or air respectively, being expedited by an injector effect of the fuel gas leaving the combustion cowl. Both the quantity of the air flowing from the first cooling jacket into the intermediate chamber and the quantity of the coolant flowing into the intermediate chamber from the second cooling jacket are controlled exclusively by the size of the throttle gaps. Such an arrangement makes it possible to base the dimensions of the air gap between the combustion cowl and the transition piece solely on structural aspects, and to make the gap very wide if necessary. Accordingly, there is no danger that large quantities of coolant or air will enter the transition piece through a wide air gap and thereby cool off the hot fuel gases.

The cooling jacket is separated into a first cooling jacket and a second cooling jacket. The first jacket surrounds the combustion cowl, is subjected to heavy thermal loads, and is cooled by the flow of the entire air of combustion. The second cooling jacket surrounds the transition piece, is subjected to a lesser thermal load, and is cooled only by the coolant flowing into the intermediate chamber. The separation of the cooling jacket into the first and second jackets accomplishes in a simple manner, a cooling system that is adjusted in accordance with specific thermal loads of the components.

A preferred further development of the present invention has the second throttle, which is adjacent to the second cooling jacket equipped with an annular part which is preferably flat and that embraces and is fastened to the transition piece. The annular part is engaged by an annular gap of an outer ring, with the ring forming the second throttle gap by leaving open a gap between itself and the outer wall of the cooling jacket. The ring consists of at least two annular segments which are connected with each other by a connecting ring. Such an arrangement makes it possible to adjust the dimensions of the second throttle gap by selecting outer rings of diverse thickness, while the division of the ring into two annular segments allows an easy and simple installation.

A particularly simple construction will result if the first throttle, which is adjacent to the first cooling jacket, is provided with a circular disk which is fastened to the outer wall of the first cooling jacket. The circular disk furthermore both enters the cooling jacket and ends at a distance from the combustion cowl to form the first throttle gap. However, it will be even more advantageous if the first throttle gap is formed between the combustion cowl and a cylindrical hollow piece which is supported by a circular partition both entering the cooling jacket and fastened to the outer wall of the cooling jacket.

In order to facilitate the flow of cooling air and coolant into the annular gap, it will expedient to arrange the hollow piece within the annular gap between the combustion cowl and the widened upper end of the transition piece.

Another preferred development of the invention provides that the coolant is preheated to a temperature ranging between the temperatures of the fuel gas and the air of combustion, preferably between 150° C. and 300° C. Such a measure leads to a considerable reduction in stresses within the area of transition.

Finally, if the combustion chamber is located directly at a gas turbine, the overall construction can be simplified by connecting the second cooling jacket with an enclosed area provided for the cooling of the gas turbine. In this way, the second cooling jacket and the enclosed area are preferably combined into one single unit.

BRIEF DESCRIPTION OF THE DRAWINGS

Additional advantageous features of the invention will become apparent from the detailed description of the preferred embodiment in connection with the appended drawings, wherein like members are denoted by like reference numerals and wherein.

DETAILED DESCRIPTION OF THE PRESENT INVENTION

Figure 1:
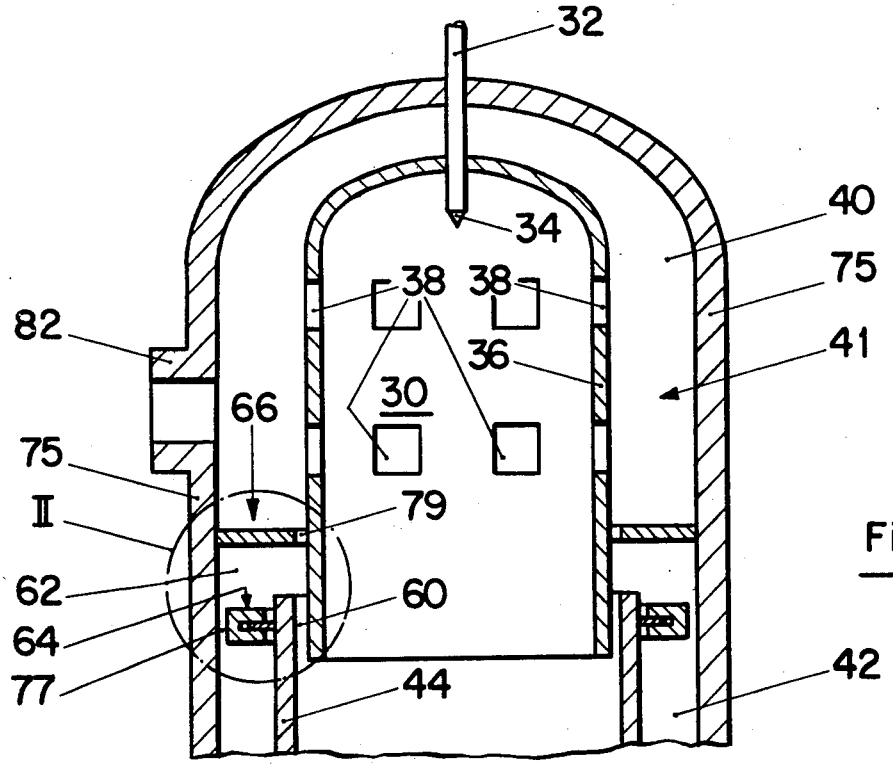
FIG. 1 is an axial longitudinal cross-sectional view of a combustion chamber in accordance with the present invention.

With reference now to FIG. 1, a combustion chamber 30 has a fuel nozzle 34 which is connected to a fuel supply line 32. The combustion chamber 30 is surrounded by a combustion cowl 36 which is closed off at an upper end while a lower end leads into the transition piece 44. The transition piece 44 connects the combustion chamber with a (not illustrated) combustion gas intake of a gas turbine engine. The combustion cowl 36 is provided with openings 38 for the supply of air. The openings 38 connect the combustion chamber 30 with the first cooling jacket 40 which is formed between the combustion cowl 36 and an outer wall 75. The wall 75 runs along and at a distance from the combustion cowl. Since the combustion cowl 36 as well as the outer wall 75 have a circular configuration, the first cooling jacket has the form of an annulus.

The transition piece 44, also designed with a circular profile, is surrounded by the second cooling jacket 42 which is formed between the transition piece 44 and the outer wall 75, and has an annular configuration in cross-section. The lower end of the second cooling jacket 42 can be closed off if desired. The second cooling jacket 42 is equipped with a connection for the coolant supply, for example in the form of a pipe fitting 100 (see FIG. 3).

The two cooling jackets 40, 42 are separated by a first throttle 66 and a second throttle 64 which are placed at an axial distance from each other so that an intermediate chamber 62 is created between the two throttles. The intermediate chamber 62 communicates with the combustion chamber 30 by way of the annular air gap 60 which is formed between the upper end of the transition piece 44 and the lower end of the combustion cowl 36 (see especially FIG. 2). The sections of the combustion cowl 36 and the transition piece 44 which overlap each other amount to approximately 1/10 to 1/20th of the inside diameter of the combustion chamber.

Figure 2:
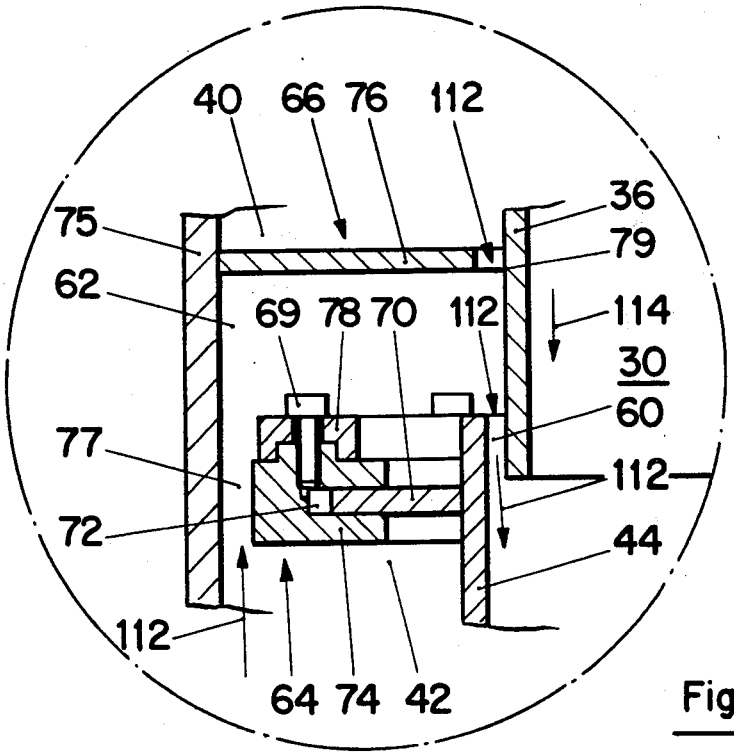
FIG. 2 is an enlarged cross-sectional view of the detail II of FIG. 1.

The second throttle 64 is arranged at a small distance (approximately 1/10 to 1/20th of the inside diameter of the combustion chamber) from the upper end of the transition piece. FIG. 2 shows that the second throttle 64 is formed primarily by a flat annular part 70 which embraces the transition piece 44. The annular part 70 runs substantially at a right angle to the longitudinal axis of the transition piece, and is fastened tightly to this transition piece 44.

The annular part 70 engages at its outer edge an inner annular gap 72 of a free outer ring 74 having a substantially rectangular cross-section and which ends in front of the outer wall 75, to thereby create the annular second throttle gap 77. The outer ring 74 consists of two identical ring segments which are connected with each other by a connecting ring 78 and by a plurality of bolts 69. The division of the outer ring 74 facilitates its installation because the outer ring 74 could not otherwise be easily placed onto the annular part 70 which is welded to the transition piece. It is further possible to adjust the air gap 77 at the time of installation by a proper selection or design of the outer diameter of the outer ring 74 in accordance with the particular operating conditions of the gas turbine engine.

The upper first throttle 66 consists of a flat circular disk 76 which is fastened tightly to the outer wall 75 and which ends in front of the combustion cowl 36, to create the annular first throttle gap 79. The circular disk 76 is placed approximately at a right angle to the longitudinal axis of the combustion chamber 30, with its distance from the second throttle 64 being approximately 1/10 to 1/20th of the combustion chamber diameter.

The combustion chamber 30 is supplied during operation of the gas turbine engine with fuel in either gaseous or liquid state by way of both the fuel supply line 32 and the fuel nozzle 34. The air required for combustion is introduced through the fitting 82 into the first cooling jacket 40, and flows from there into the combustion chamber 30 by way of the air-supply openings 38. The generated hot combustion gases will enter the transition piece 44 and are conducted from there to the combustion gas intake of the gas turbine (see FIG. 3). The second cooling jacket 42 is also supplied with air at a pressure which is higher than the pressure of the combustion gas within the region of transition from the combustion cowl 36 to the transition piece 44. Therefore, the air will flow through the second throttle gap 77 into the intermediate chamber 62 and from there will flow through the air gap between the combustion cowl 36 and the transition piece 44. The air will also flow simultaneously from the first cooling jacket 40 into the intermediate chamber 62 by way of the first throttle gap 79 and into the transition piece 44 by way of the air gap 60 (see arrows 112 in FIGS. 2 and 4). This movement of air is intensified by the injector effect caused by the flow of combustion gas from the combustion chamber 30 into the transition piece 44 (see the arrow 114 in FIGS. 2 and 4).

The air, used in the example illustrated as the cooling agent, can be delivered to the second cooling jacket 42 in various manners, for example by means of a blower or a compressor or by use of an air storage unit. It is also possible to employ an inert gas, such as nitrogen, as the coolant medium which is compressed and stored in metal cylinders. It is preferable, however, to use air for reasons of simplicity.

Figure 3:
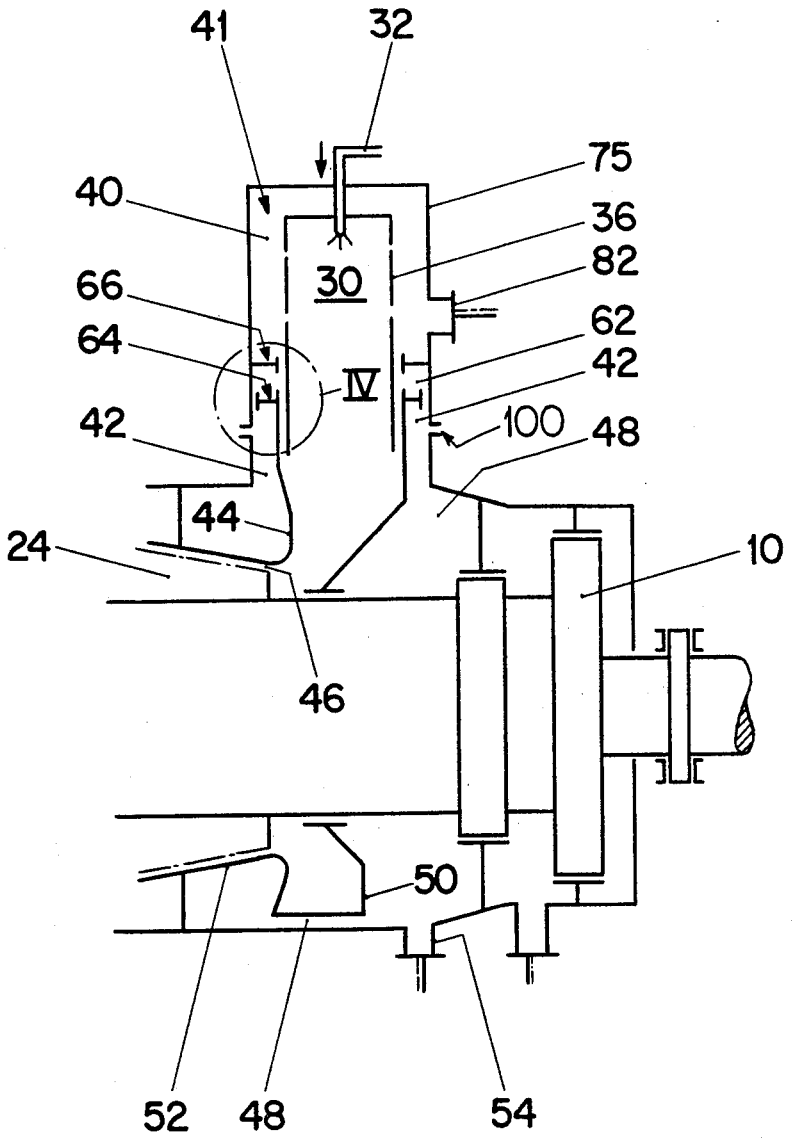
FIG. 3 is an axial longitudinal cross-sectional view of one portion of a gas turbine engine having a combustion chamber in accordance with the present invention, fastened directly at the turbine housing; and, FIG. 4 is an enlarged cross-sectional view of the detail IV of FIG. 3.

With reference now to FIG. 3, the combustion chamber may be fastened radially at the housing of a gas turbine engine. The transition piece 44 leads directly to the combustion gas intake 46 of the turbine stage 24 having blades fastened to the shaft 10. The fuel-gas intake 46 is formed by a hollow annular part 50 which is attached to the transition piece 44 and which opens in the direction of the turbine blades. The annular part 50, one portion of the shaft 10 and the pedestal area of the entrance blades 52 is surrounded by an enclosed area 48 which can be supplied with a coolant, preferably air by way of a fitting 54. The description given in connection with FIGS. 1 and 2 concerning the selection and the supply of the coolant is applicable in FIG. 3 wherein the transition piece 44 enters the enclosed area 48. The area 48 and the second cooling jacket 42 are formed as one unit with the result that the gaseous coolant, conducted into the enclosed area 48, cools the transition piece, and simultaneously enters the second cooling jacket as a coolant, thereby reducing the size of the apparatus.

Figure 4:
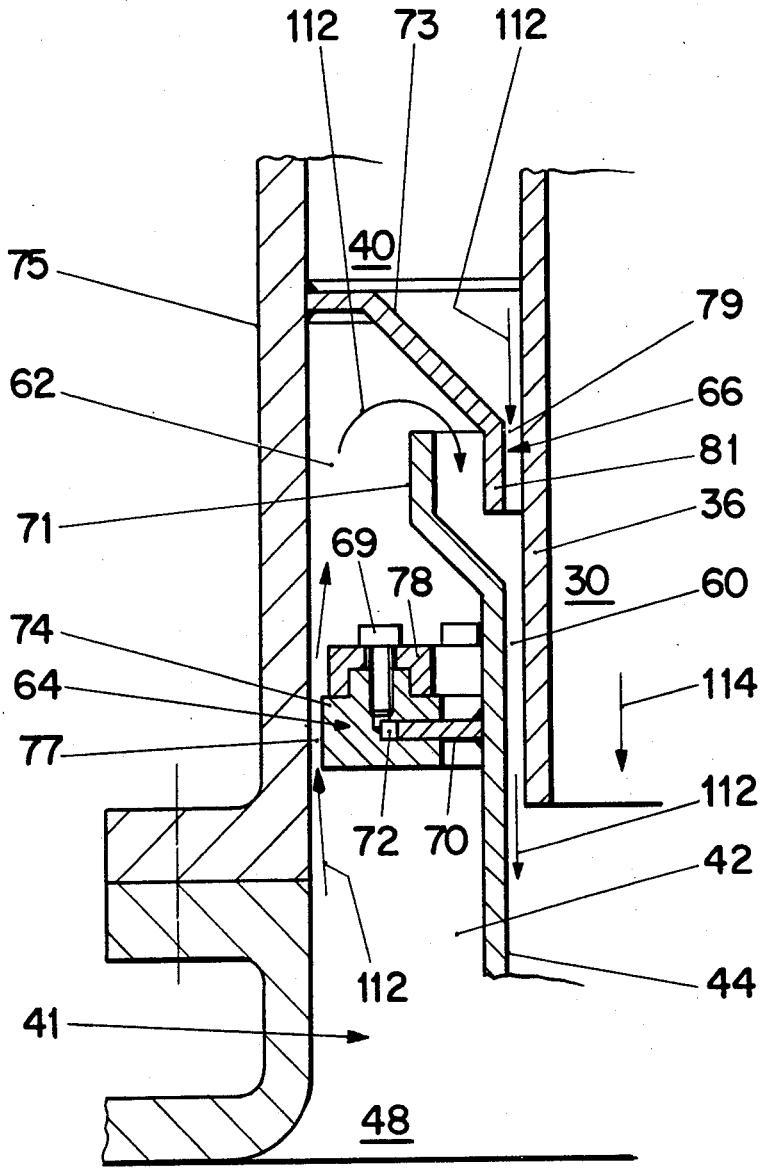

With reference now to FIG. 4 (the detail IV of FIG. 3), the lower, second throttle 64 is arranged and constructed in the same manner as the throttle 64 shown in FIG. 2 while the upper, first throttle 66 has another configuration in accordance with a still further development of the present invention.

The second throttle 66' (see FIG. 4) includes a thin-walled, cylindrical hollow piece 81 which surrounds the combustion cowl 36, to thereby form the second throttle 79'. A hollow piece 81 is fastened at an upper end to a funnel-shaped partition 73 which defines the first cooling jacket 40 and which is tightly fastened to the outer wall 75. The hollow piece 81 is surrounded by an upper end 71 of the transition piece 44'. The upper end 71 is widened for this purpose so as to have a cylindrical shape, in the manner of a sleeve, so that an annular gap is maintained between the hollow piece 81 and the end 71. The gap can be made as wide as desired while the throttle gap 77 and 79 are dimensioned so that they will permit the passage of proper and sufficient quantities of air or other coolants.

The flow through the intermediate chamber 62' is basically identical with the flow through the chamber 62 of FIG. 2 and is indicated by arrows 112. It should be noted, however, that the specific shape of the partition 73, that is the tapering in a downward direction, intensifies the flow of cooling air from the first cooling jacket 40 to the first throttle gap 79'. Obviously, it is also possible to arrange the throttle 66 of FIG. 2 in the manner of the throttle 66' of FIG. 4, and vice versa.

The combustion chamber proposed by the present invention offers a particular advantage in that it allows the combustion cowl and the transition piece to expand freely and unimpededly while providing a simple and a positive cooling for the area of junction of these two components. Furthermore, the separation of the cooling jacket 41 into a first cooling jacket which surrounds the combustion cowl and a second cooling jacket which surrounds the transition piece makes possible a cooling system that corresponds to the various loads of these components. The interconnection of the second cooling jacket with a cooling chamber or cooling system of a turbine stage results in a simplification of the overall coolant supply system.

The invention which is intended to be protected has been described by way of a preferred embodiment and is not to be construed as limited to the particular forms disclosed since these are intended to be regarded as illustrative rather than restrictive. Variations and changes may be made by those skilled in the art without departing from the spirit of the present invention.

What is claimed is:

1. A combustion chamber for a gas turbine engine, comprising:

combustion cowl means for admitting an oxidizing fluid to a fuel fluid within the combustion cowl;

transition means for receiving hot power gases from the combustion cowl means;

first cooling jacket means for substantially surrounding the combustion cowl means with the oxidizing fluid;

second cooling jacket means for substantially surrounding the transition means with a gaseous medium;

at least one air gap provided between the combusiton cowl means and the transition means;

an intermediate chamber in fluid communication with the at least one air gap;

first throttle means for separating the intermediate chamber from the first cooling jacket means; and second throttle means for separating the intermediate chamber from the second cooling jacket means.

2. The combustion chamber of claim 1 wherein the first throttle means includes a first throttle and the second throttle means includes a second throttle, the first and second throttles being arranged oppositely to one another in the intermediate chamber.

3. The combustion chamber of claim 1, wherein the second cooling jacket means is supplied with a gaseous coolant at a pressure above the pressure of the hot power gases between the combustion cowl means and the transition means.

4. The combustion chamber of claim 2 wherein the first throttle includes a first throttle gap and the second throttle includes a second throttle gap.

5. The combustion chamber of claim 1 wherein the combustion cowl means includes a combustion cowl having a plurality of apertures in fluid communication with the first cooling jacket.

6. The combustion chamber of claim 3 wherein the gaseous coolant is air.

7. The combustion chamber of claim 2 wherein the second throttle includes an annular member which is secured to the transition means and which engages an outer ring member in an annular gap of the outer ring member, the outer ring member forming the second throttle with the cooling jacket means.

8. The combustion chamber of claim 7, wherein the outer ring member includes first and second annular portions which are connected together by a third annular portion.

9. The combustion chamber of claim 2 wherein the first throttle includes a circular disk which is secured to the first cooling jacket means, the circular disk forming the first throttle with the combustion cowl means.

10. The combustion chamber of claim 2 wherein the first throttle includes a cylindrical portion which is secured to the first cooling jacket means by a circular portion, the cylindrical portion forming the first throttle with the combusiton cowl means.

11. The combustion chamber of claim 10 wherein the transition means includes a transition member having an upper, widened portion with the cylindrical portion provided between the upper, widened portion and the combustion cowl means.

12. The combustion cowl of claim 1 wherein the gaseous medium of the second cooling jacket is pre-heated to a temperature between the temperature of the fuel fluid and the oxidizing fluid.

13. The combustion cowl of claim 12, wherein the gaseous medium is pre-heated to a temperature between 150° C. and 300° C.

14. The combustion cowl of claim 1 wherein the second cooling jacket means is in fluid communication with an enclosed chamber for the cooling of a portion of the gas turbine engine.

15. A method of combusting fuel for a gas turbine engine, comprising the steps of:

admitting an oxidizing fluid and a fuel fluid to a combusiton cowl;

cooling the combustion cowl in a first cooling jacket with the oxidizing fluid prior to entry of the oxidizing fluid to the combustion cowl;

directing hot power gases from the combustion cowl to a transition member;

cooling the transition member in a second cooling jacket with a gaseous medium;

providing an air gap between the combustion cowl and the transition member;

communicating an intermediate chamber with the air gap;

communicating the intermediate chamber with the first cooling jacket;

communicating the intermediate chamber with the second cooling jacket; and throttling the communication between the intermediate chamber and the second cooling jacket.

16. The method of claim 15, further comprising the step of supplying a gaseous coolant at a pressure above the pressure of the hot power gases between the combustion cowl and the transition member to the second cooling jacket.

17. The method of claim 15 further comprising the step of:

preheating the gaseous medium of the second cooling jacket to a temperature between the temperature of the fuel fluid and the oxidizing fluid.

18. The method of claim 15, further comprising the step of preheating the gaseous medium of the second cooling jacket to a temperature between 150° C. and 300° C.

19. The method of claim 15, further comprising the step of intensifying the fluid communication between the intermediate chamber and the air gap by flowing the hot power gas substantially parallel and in close proximity with the air gap.

* * * * *